United States Patent [19]

Slattery

[11] Patent Number: 4,875,883

[45] Date of Patent: Oct. 24, 1989

[54] LATCH ASSEMBLY FOR RELEASABLY SECURING COWL SECTIONS OF AN OUTBOARD MOTOR

[75] Inventor: Gordon C. Slattery, Omro, Wis.

[73] Assignee: Brunswick Corporation, Skokie, Ill.

[21] Appl. No.: 219,081

[22] Filed: Jul. 14, 1988

[51] Int. Cl.[4] ..... B63H 21/26

[52] U.S. Cl. ..... 440/77; 123/195 P

[58] Field of Search ..... 440/76, 77; 292/24, 292/95, 96, 100, 101, 130; 123/195 P

[56] References Cited

U.S. PATENT DOCUMENTS

| | | | |
|---|---|---|---|
| 711,696 | 10/1902 | Cook | 292/130 |
| 1,180,050 | 4/1916 | Landauer | 292/101 |
| 3,773,010 | 11/1973 | Elingsen | 123/195 P |
| 3,955,526 | 5/1976 | Kusche | 123/195 P |
| 4,216,984 | 8/1980 | Hofmann et al. | 292/91 |
| 4,600,396 | 7/1986 | Crane et al. | 440/77 |

FOREIGN PATENT DOCUMENTS

| | | | |
|---|---|---|---|
| 161692 | 9/1983 | Japan | 440/77 |
| 60-60098 | 4/1985 | Japan | 440/76 |

*Primary Examiner*—Sherman D. Basinger

*Attorney, Agent, or Firm*—Andrus, Sceales, Starke & Sawall

[57] ABSTRACT

A cowl assembly for an outboard motor, including an upper cowl section and a lower cowl section, is provided with an improved latch assembly. The latch assembly incorporates a pivotable hook connected to one of the cowl sections, which is engageable with a hook-engaging member provided on a catch mechanism connected to the other cowl section. Due to the presence of a compressible seal between the upper and lower cowl sections, relative vertical movement is possible therebetween, and thereby between the hook and the hook-engaging member. The improved latch mechanism incorporates a retainer mechanism for preventing disengagement of the hook from the catch mechanism during such relative vertical movement of the cowl sections, for ensuring that the cowl sections remain secured together during compression of the compressible seal between the cowl sections.

12 Claims, 1 Drawing Sheet

LATCH ASSEMBLY FOR RELEASABLY SECURING COWL SECTIONS OF AN OUTBOARD MOTOR

BACKGROUND AND SUMMARY

This invention relates to an outboard motor for a marine propulsion system, and more particularly to a latch structure for releasably securing separate cowl sections of an outboard motor.

It is known to provide a pivotable hook-type latch assembly for releasably securing upper and lower cowl sections for an outboard motor. Such a latch assembly typically includes a pivotably mounted hook interconnected with a pivotable latch lever. These components are mounted to one of the cowl sections. The other cowl section is provided with a catch assembly, which typically includes a stationary hook-engaging member. By operation of the pivotable lever, the hook is movable between an engaging position in which it engages the hook-engaging member provided on the catch assembly for securing the cowl sections together, and a disengaging position in which the hook and the hook-engaging member are disengaged, for releasing the cowl sections.

The above-described latch construction is typically employed in connection with a cowl design incorporating top and bottom cowl sections. In such a design, a compressible resilient rubber seal is typically provided between the cowl sections for improving the water resistance of the cowl assembly. Stationary mating engagement means is provided for fixing the position of the cowl sections relative to each other at one end of the cowl assembly, typically the front. The pivotable latch assembly and its associated catch assembly are provided at the other end of the cowl assembly, typically the rear, for releasably securing the cowl sections together upon engagement thereof. The latch assembly is designed to compress the rubber seal provided between the cowl sections for improving the water resistance of the cowl assembly and for providing opposing forces on the hook and catch for ensuring that the hook and catch remain engaged.

It has been recognized that the hook may become disengaged with the catch under certain operating conditions, resulting in disengagement of the top and bottom cowl sections. For example, when the lower unit of the outboard motor strikes a stationary obstacle, such as a submerged log or rock, the entire outboard motor assembly is caused to pivot about its tilt axis. In such a situation, the bottom cowl section pushes upwardly, on the rubber seal, while the top cowl section simultaneously pushes downwardly on the rubber seal, due to its inertia. In such a situation, the rubber seal is compressed, and the hook moves upwardly out of engagement with the hook-engaging member of the catch assembly. The latch lever, due to its inertia, may then pivot about its pivot axis, thus moving the hook to its disengaging position. As the outboard motor continues to pivot about its tilt axis and strikes the stops which define the allowable tilting movement of the unit, the top cowl section may continue to move forwardly due to its inertia and come loose from the bottom cowl section.

The present invention is designed to eliminate the possibility that the cowl sections may become disengaged during operation. In accordance with the invention, a latch assembly for releasably securing first and second cowl sections together includes a catch mechanism connected to one of the cowl sections and a latch mechanism connected to the other of the cowl sections. The latch mechanism is movable between an engaging position in which the catch mechanism is engaged for securing the cowl sections together, and a disengaging position in which the latch mechanism and the catch mechanism are disengaged, for releasing the cowl sections. The latch mechanism is capable of movement, when in its engaging position, out of engagement with the catch mechanism so as to be movable toward its disengaging position. Retainer means is provided for engaging the latch mechanism during such movement thereof out of engagement with the catch mechanism when the latch mechanism is in its engaging position, so as to prevent the latch mechanism from moving to its engaging position. In one embodiment, the latch mechanism includes a pivotably mounted hook movable in a first direction toward its engaging position and in a second direction toward its disengaging position. The hook is capable of movement in a third direction, other than the first and second directions, caused by compression of the compressible seal provided between the first and second cowl sections. In a typical application, the third direction is typically upwardly or downwardly vertical. The retainer means comprises a detent means provided on the hook, and engagement means held stationary relative to the catch mechanism for engaging the detent means on the hook during movement of the hook in the third direction. Upon such engagement, rotation of the hook toward its disengaging position is prevented. In a preferred embodiment, the hook is provided with an indentation, and the catch mechanism includes a tab aligned with the hook indentation when the hook is in its engaging position. In this manner, vertical movement of the indentation caused by compression of the compressible seal causes engagement of the tab with the indentation provided on the hook. The tab and indentation are preferably arranged so as not to interfere with normal movement of the hook in the first and second directions for engaging and disengaging the hook-receiving member of the catch mechanism. Rotation of the hook is only prevented during vertical movement of the hook caused by compression of the compressible seal beyond that normally provided by the hook upon its engagement with the catch mechanism.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
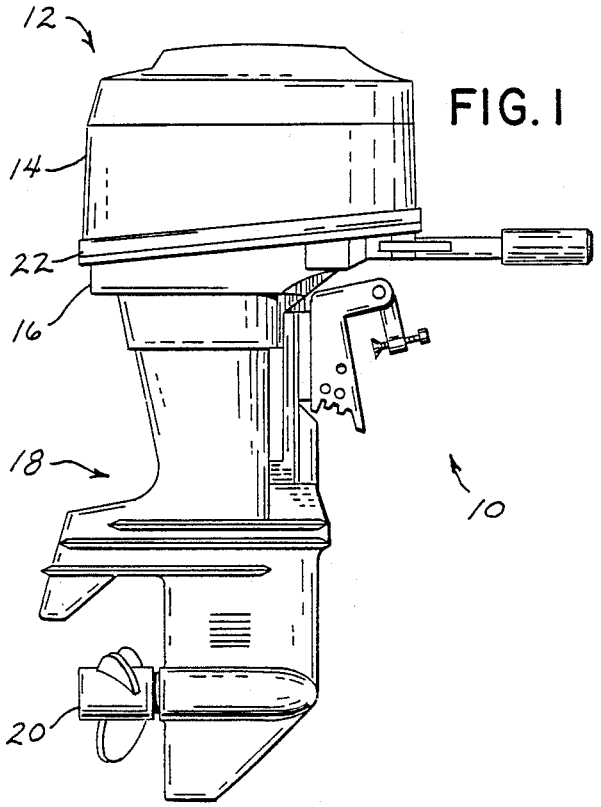
FIG. 1 is a side elevation view of an outboard motor having a power head enclosed by top and bottom cowl sections with a compressible seal therebetween.

With reference to FIG. 1, an outboard motor 10 includes a power head 12 enclosed by an upper cowl section 14 and a lower cowl section 16. As is well known, a depending gearcase 18 houses the drive components and transmission which transfer power from power head 12 to a propeller 20 for driving a boat.

A compressible rubber seal 22 is provided at the joint between upper and lower cowl sections 14, 16. Rubber seal 22 acts to improve the water resistance of the cowl assembly for preventing entry of water into the interior thereof.

Figure 2:
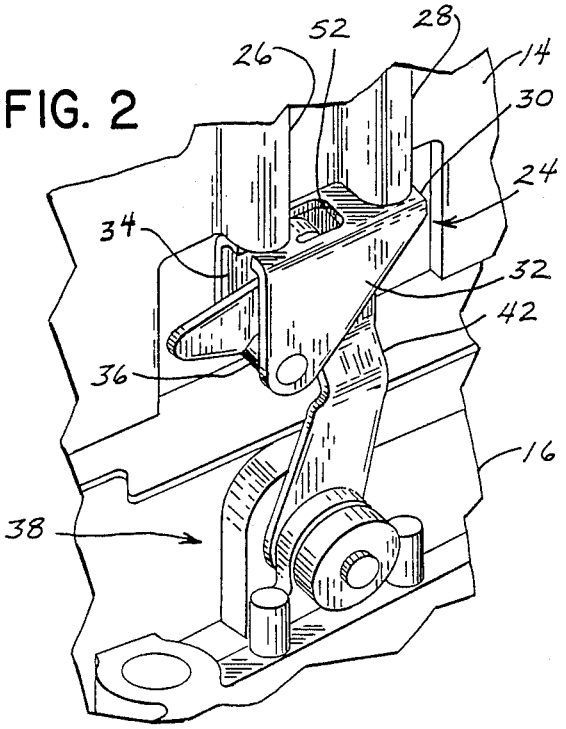
FIG. 2 is a partial isometric view of a latch assembly constructed according to the invention, located in the interior of the top and bottom cowl sections for releasably securing the cowl sections together.

As shown in FIG. 2, upper cowl section 14 has a catch mechanism, shown generally at 24, mounted at the lower ends of a pair of longitudinal bosses 26, 28 formed integrally therewith. Catch mechanism 24 is a bracket-type member having an upper surface 30 and a pair of depending side surfaces 32, 34. A roller 36 spans between the lower ends of side surfaces 32, 34, and is rotatably mounted to a pin 37 connected between side surfaces 32, 34.

Figure 3:
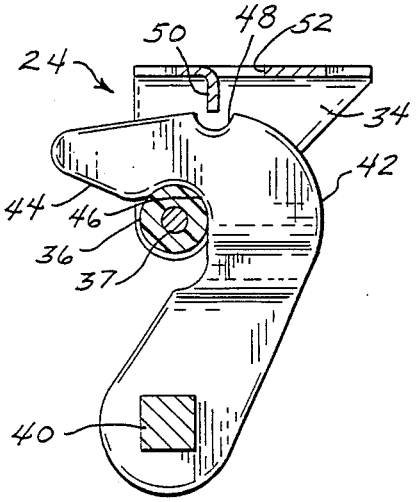
FIG. 3 is an elevation view of the latch assembly of FIG. 2, showing the latch and catch assemblies in their normal operating position.
Figure 4:
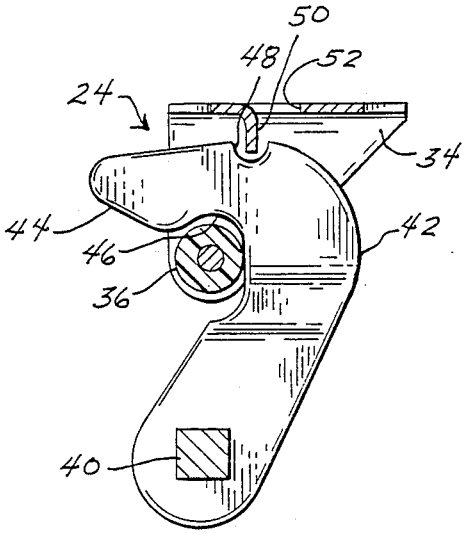
FIG. 4 is a view similar to FIG. 3, showing upwardly vertical movement of the hook out of engagement with the hook-engaging member of the catch assembly and engagement of the retainer means of the invention for preventing movement of the hook to its disengaging position.

Lower cowl section 16 has a rotary latch mechanism 38 mounted thereto. Latch mechanism 38 includes an external rotatable latch handle or lever (not shown), which has a square opening therethrough adapted to mate with a portion of square cross section provided on a shaft 40 (FIGS. 3, 4). For a more detailed description of latch mechanism 38, reference is made to copending application Serial No. 07/077,689 filed July 24, 1987, now U.S. Pat. No. 4,800,854, and incorporated herein by reference.

Latch mechanism 38 further includes a pivotable internally mounted hook 42 mounted to the square cross sectional portion of shaft 40. As is known, and as is described in the above-referenced application, hook 42 is mounted so as to be pivotable in response to pivoting movement of shaft 40 caused by the pivotably mounted latch handle or lever. Hook 42 is pivotable in a counterclockwise direction toward its engaging position, such as is shown in FIGS. 2 and 3 wherein hook 42 is engaged with roller 36. Hook 42 is pivotable in a clockwise direction toward its disengaging position in which hook 42 and roller 36 are disengaged. When hook 42 is in its engaging position, upper and lower cowl sections 14, 16 are secured together.

As is known, hook 42 has a canted surface 44 which leads to a pocket 46 adapted to receive roller 36. Canted surface 44 engages roller 36 during pivoting movement of hook 42 toward its engaging position for guiding roller 36 into pocket 46.

FIG. 3 illustrates hook 42 and catch mechanism 24 with hook 42 in its engaging position during normal operation of the boat. When the lower unit of outboard motor 10 strikes a submerged obstacle, thereby compressing rubber seal 22, hook 42 is caused to move upwardly out of engagement with roller 36, as shown in FIG. 4. In this situation, hook 42 is movable toward its disengaging position, thereby creating the potential for releasing upper and lower cowl sections 14, 16.

As a retainer means for preventing movement of hook 42 to its disengaging position during this situation, hook 42 is provided on its upper surface with an indentation 48, and upper surface 30 of catch mechanism 24 is provided with a depending tab 50. As shown, tab 50 and indentation 48 are substantially aligned when hook 42 is in its engaging position. Upon upward movement of hook 42, as shown in FIG. 4, tab 50 engages indentation 48 and effectively prevents clockwise rotation of hook 42 to its disengaging position during this situation. As is readily understood, the upward movement of hook 42 as shown in FIG. 4 lasts only a short period of time, as rubber seal 22 quickly decompresses to return hook 42 and catch mechanism 24 to their normal operating position as shown in FIG. 3.

As shown, tab 50 is formed from a cut-out portion 52 provided in upper surface 30 of catch mechanism 24. With the construction as shown and described, tab 50 does not interfere with normal operation of hook 42 between its engaging and disengaging positions. Only upon upward movement of hook 42 out of engagement with roller 36, as shown in FIG. 4, does tab 50 come into play to prevent movement of hook 42 toward its disengaging position.

Various alternatives and modifications are contemplated as being within the scope of the following claims particularly pointing out and distinctly claiming the invention.

I claim:

1. For an outboard motor or the like having a power head enclosed by first and second cowl sections, wherein a compressible seal is provided at a joint formed between said first and second cowl sections, a latch assembly for releasably securing said first and second cowl sections together, comprising:

catch means connected to one of said cowl sections;

latch means movably connected to the other of said cowl sections, said latch means being movable between an engaging position in which said latch means engages said catch means for securing said cowl sections together during normal operation and providing compression to said compressible seal and a disengaging position in which said latch means and said catch means are disengaged, wherein further compression of said compressible seal when said latch means is in its engaging position causes movement of said latch means out of engagement with said catch means so as to be movable toward its disengaging position; and retainer means for engaging said latch means during movement of said latch means out of engagement with said catch means when said latch means is in its engaging position, so as to prevent said latch means from moving to its disengaging position.

2. The latch assembly according to claim 1, wherein said latch means comprises a hook pivotably mounted to one of said cowl sections so as to be pivotable between said engaging and disengaging positions.

3. The latch assembly according to claim 2, herein said catch means includes a hook-engaging ember with which said pivotable hook is engageable for securing said first and second cowl sections together.

4. The latch assembly according to claim 3, wherein said hook is movable in a first direction toward its engaging position, and in a second direction opposite said first direction toward its disengaging position, and wherein further compression of said compressible seal when said hook is in its engaging position causes movement of said hook out of engagement with said hook-engaging member of said catch means, said movement of said hook out of engagement with said hook-engaging member being in a direction other than said first and second directions.

5. The latch assembly according to claim 4, wherein said retainer means for engaging said latch means during movement of said latch means out of engagement with said catch means engages said hook during such movement of said latch means for preventing said hook from pivoting to its disengaging position.

6. The latch assembly according to claim 5, wherein said retainer means comprises detent means provided on said hook, and engagement means held stationary relative to said catch means for engaging said detent means during movement of said latch means out of engagement with said catch means, said detent means and said engagement means being arranged so as to allow movement of said hook between its engaging and disengaging positions during normal operation.

7. The latch assembly according to claim 6, wherein said detent means comprises an indentation formed in said hook, and said engagement means comprises a tab adapted to engage said indentation during movement of said latch means out of engagement with said catch means so as to prevent movement of said hook to its disengaging position.

8. The latch assembly according to claim 7, herein said catch means comprises a bracket having a top surface and a side surface to which said hook-engaging member is connected, said hook being adapted for pivotable movement in said first direction between said top surface and said hook-engaging member toward its engaging position for engaging said hook-engaging member, said hook being movable vertically toward said upper surface of said bracket during movement of said latch means out of engagement with said catch means, and wherein said tab projects from said top surface of said bracket and is aligned with said indentation in said hook when said hook is in its engaging position, so that vertical movement of said hook out of engagement with said catch means causes engagement of said projecting tab with said indentation in said hook for preventing rotation of said hook to its disengaging position.

9. A cowl assembly for an outboard motor or the like, comprising:

a first cowl section;

a second cowl section adapted to abut said first cowl section so as to form a joint therebetween;

compressible seal means provided at said joint for sealing between said first and second cowl sections;

a latch assembly for releasably securing said first and second cowl sections together, comprising:

catch means connected to one of said cowl sections; and latch means movably connected to the other of said cowl sections, said latch means being movable in a first direction to an engaging position for engaging said catch means and in a second direction to a disengagng position for releasing said catch means, said latch means being capable of movement in a third direction, other than said first and second directions, out of engagement with said catch means when said compressible seal means at said joint between said cowl sections is compressed; and retainer means for engaging said latch means during movement of said latch means in said third direction when said latch means is in its engaging position, and thereby preventing movement of said latch means to its disengaging position.

10. The cowl assembly according to claim 9, wherein said latch means comprises a hook pivotably mounted to one of said cowl sections, and said catch means comprises a hook-engaging member connected to the other of said cowl sections with which said hook is releasably engageable for releasably securing said cowl sections together.

11. The cowl assembly according to claim 10, wherein said retainer means comprises detent means provided on said hook, and stationary engagement means for engaging said detent means during movement of said hook in said third direction, said detent means and said engagement means being arranged so as to allow movement of said hook between its engaging and disengaging positions when said seal means is not compressed, and to prevent such movement when said seal means is compressed.

12. The cowl assembly according to claim 11, wherein said detent means comprises an indentation formed in said hook, and said engagement means comprises a tab adapted to engage said indentation during movement of said latch means in said third direction for preventing movement of said catch means to its disengaging position.

* * * * *

UNITED STATES PATENT AND TRADEMARK OFFICE

CERTIFICATE OF CORRECTION

PATENT NO. : 4,875,883

DATED : 10/24/89

INVENTOR(S) : Slattery, Gordon C.

It is certified that error appears in the above-identified patent and that said Letters Patent is hereby corrected as shown below:

Claim 3, Col. 4, Line 52, delete "herein" and substitute therefor --- wherein ---;

Claim 3, Col. 4, Line 52, delete "ember" and substitute therefor --- member ---;

Claim 8, Col. 5, Line 21, delete "herein" and substitute therefor --- wherein ---.

Signed and Sealed this

Nineteenth Day of March, 1991

*Attest:*

HARRY F. MANBECK, JR.

*Attesting Officer*

*Commissioner of Patents and Trademarks*